United States Patent [19]

Sherry

[11] 4,401,184

[45] Aug. 30, 1983

[54] ROOF SKID

[76] Inventor: Howard W. Sherry, 111 Webster Ave., Stratford, N.J. 08084

[21] Appl. No.: 360,210

[22] Filed: Mar. 22, 1982

[51] Int. Cl.[3] ..... E04G 3/12

[52] U.S. Cl. ..... 182/45; 182/115; 182/163; 182/206; 248/237

[58] Field of Search ..... 182/45, 150, 115, 116, 182/120, 121, 163, 164, 206, 222; 248/237

[56] References Cited

U.S. PATENT DOCUMENTS

| | | | |
|---|---|---|---|
| 499,826 | 6/1893 | Farland | 182/45 |
| 681,649 | 8/1901 | Chase | 182/45 |
| 1,290,926 | 1/1919 | Decker | 182/45 |
| 1,365,996 | 1/1921 | Herwick | 182/45 |
| 1,586,038 | 5/1926 | Hall | 248/237 |
| 2,275,014 | 3/1942 | Hahler | 182/45 |
| 2,426,825 | 9/1947 | Geary | 182/45 |
| 2,840,424 | 6/1958 | Broderick | 182/45 |

*Primary Examiner*—Reinaldo P. Machado

[57] ABSTRACT

A roof skid including a floor supported above the ridge of a roof and resting thereon, with edge support devices extending from the frame and interlocking at chosen positions on a foot member resting on the surface of the roof, with ladder roof jacks depending from rails of the skid on which scaffold carriages are slidably attached along the ladder length.

26 Claims, 6 Drawing Figures

ROOF SKID

BACKGROUND OF THE INVENTION

1. Field of Invention

The field of this invention is scaffolding suitable for use on pitch or gable roofs. In particular, the invention involves staging devices for use on roofs and involves ladders that are used with and are part of the invention. When undertaking construction projects on a roof such as replacing the roof and, in particular, covering a roof, it is desirable to provide a scaffolding system for the workers to stand on, to store the materials being used, and to hold the tools and equipment necessary for the work. In particular, when laying a new roof, it is most desirable to provide a place for the bundles of shingles to be stored off the surface that is being covered. Various types of staging and scaffolding for various purposes have been utilized which hook over the ridge of the roof or are supported from below. The terms "ridge" and "peak" are used interchangeably throughout the balance of the specification.

2. The problems with present scaffolding systems

Scaffolding was originally constructed of wood from the ground up and it was sometimes necessary to spend more time constructing the scaffolding than it took to finish the work. In addition, safety of such structures always depended upon the care of construction and the design of the scaffolding.

Board supports are typically nailed to the roof through the old shingles. Unfortunately, this damages the roof, is not safe due to the nails pulling out and must be moved many times during the covering of the roof.

Hooks were used to hook over the ridge of the roof on which a stage was hung or a support mechanism was provided for holding boards at various levels, up and down the roof line. One of the immediate problems with such devices was that the device covered the very surface on which work was being performed. It was essentially impossible to work in those areas near the ridge of the roof without dismantling the device and there was insufficient stability and safety to hold the large bundles of shingles in position during the resurfacing process.

In addition, these devices provided for support of a work area on only one side of the roof at a time. Therefore, it was not possible to work on both sides of the roof at the same time with a larger crew in order to get construction jobs done more quickly.

Many of the devices substantially damaged the surface of the roofs on which they were placed. While the devices were satisfactory from that standpoint, when completing the first side of a recovering job, covering the second side with the device in place damaged the new roof after it was laid.

In particular, scaffold systems provided support mechanisms that did not safely lock in place, and through wear or lack of care, provided a safety hazard to the workers.

Scaffold systems used for the repair of chimneys are generally not useful for roof covering operations inasmuch as the work area is not close enough to the roof surface to allow laying the roof.

OBJECT OF INVENTION

None of the prior art scaffold devices have provided an answer to the limitations and failures of the various devices involved as outlined above. Accordingly, it is an object of this invention to provide a roof skid with a stable and safe working surface.

It is a further object of this invention to provide a roof skid capable of supporting carriages on both sides of a ridge roof, allowing work to continue on both sides at the same time.

It is a further object of this invention to provide storage area on the roof sufficient to hold all the materials involved in construction or covering the roof.

It is an additional object of this invention to provide a roof skid that eliminates the need for moving the support mechanisms many times during the completion of covering a roof.

It is an object of this invention to provide a stable platform for workers and storage of materials which also serves to support one or more ladder jacks from either side of the platform.

It is a further object of this invention to provide a roof skid that will fit at the ridge of any roof regardless of the pitch.

It is a further object of this invention to provide roofing contractors with a structure that holds the roofing materials at the peak of the roof so that the materials are always being brought down to the workplace rather than up from the ground to the workplace.

It is an additional object of this invention to provide a storage area, together with two carriages to hold a jacking plank for working along the surface of the roof.

It is an object of this invention to provide a structure that supports workers near the sloped roof surface.

It is an object of this invention to provide a scaffold system that will safely support longer scaffold boards.

SHORT STATEMENT OF THE INVENTION

The invention is a roof skid suitable for placement on the ridge of a sloped roof of a structure including a frame that includes side members along the length of the skid, the length of the skid to be laid along the same direction of the ridge of the roof. A frame support provides support for the frame to rest on the ridge of the roof and on both sides of the roof to support the roof skid. At least one hanging support device is attached on a side member to support hanging weight. At least one pivot angle ladder is attached to swing on the hanging support device and depend from the side member toward the sloping roof surface. A lateral lower ladder is rigidly attached but is adjustable to a chosen angle to the lower end of the pivot angle ladder. At least two feet devices extend from the lower ladder to rest on the roof surface and support the lower ladder essentially parallel to the sloped roof surface.

DESCRIPTION OF PREFERRED EMBODIMENTS

Figure 1:
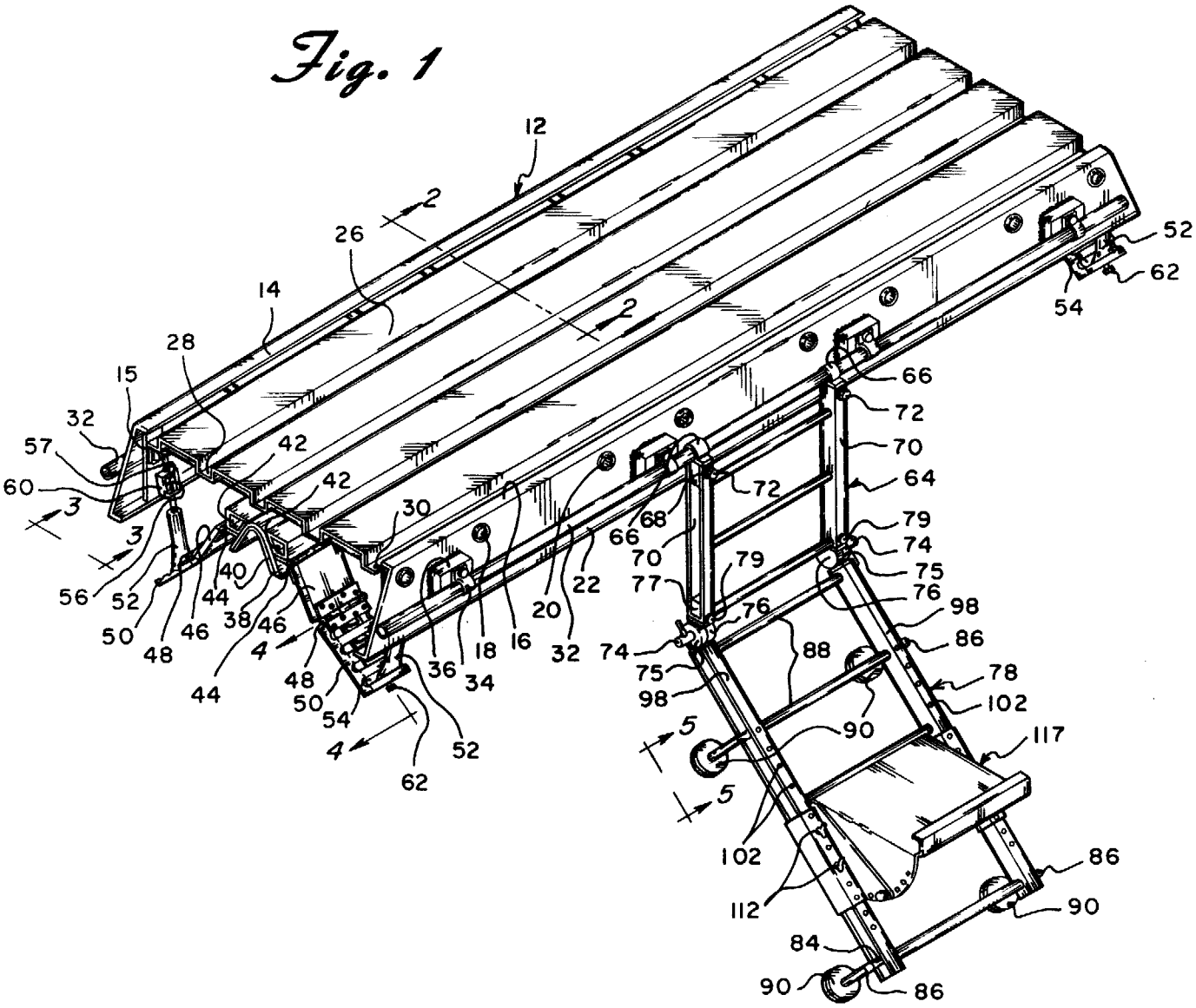
FIG. 1 is a perspective view of a roof skid of this invention including a depending ladder device and a carriage system.
Figure 2:
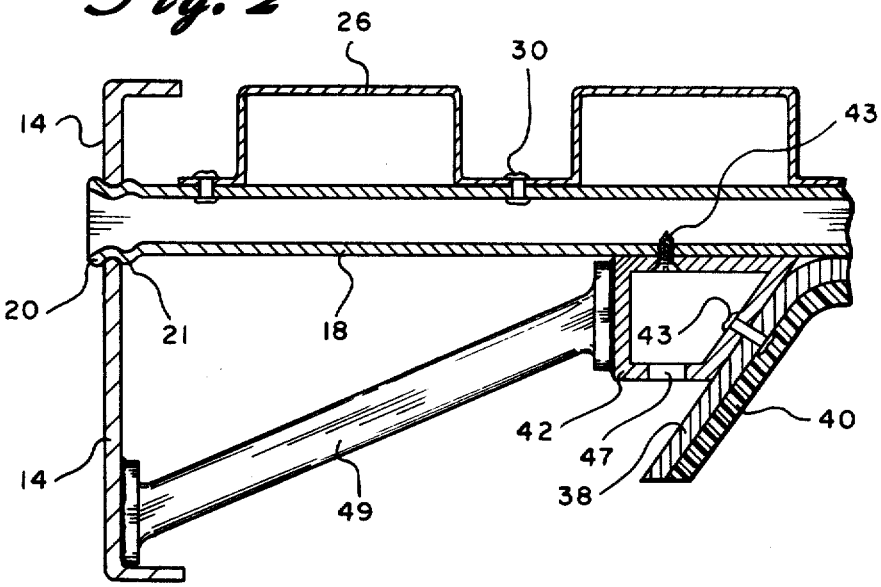
FIG. 2 is a partial cross-sectional view taken along lines 3—3 of FIG. 1 to illustrate the construction of the roof skid.

Preferred embodiments include the roof skid described above wherein the frame includes a structure extending the width of the skid between the side members providing transverse support to hold the rail in parallel relationship, together with a floor covering the frame. It is preferred that the structure include a plurality of cross members such as aluminum tubes, extending the width of the skid structurally attached at the ends to the side members. The floor is attached to the structure between the side members. The frame support preferably includes a ridge support device extending the length of the skid and allowing the frame weight to rest on the ridge of the roof and on sufficient surface area on both sides of the roof to support the skid. The ridge support may be a "V" shaped beam conforming generally to the shape of the ridge of the roof preferably with the angle of the "V" shaped slightly less than that of the roof ridge. It is preferred that the angled beam support for the roof ridge be covered with a resilient padding. In the support structure for the frame it is preferred that a trapezoidal shaped extrusion beam be structurally attached along the length of the ridge supports and to the frame. The frame support preferably includes at least four side support devices at each corner of the frame, each including a roof support member hingably attached to the frame near the ridge support and extending toward the roof surface; a lower angled foot support member hingably attached to the free end of the roof support member; a vertical support member hingably attached to the frame near the side member; and an interlocking device to attach and interlock the free end of the vertical support member to the foot support member at selected points along the length of the foot support member, thereby adjusting the foot of the support member in a vertical direction along the slope of the roof. The foot support preferably has a plurality of generally horizontal transverse grooves, spacably placed along the upper surface of the foot support. The interlocking means preferably includes an opening on the free end of the roof support member which fits in the grooves of the foot support member and an interlocking device to hook the opening and hold the free end of the groove in an interlocking relationship. The hanging support means preferably comprises a horizontal rod attached along the outside of the side member of the frame. For maximum support there are two hanging support devices each detached on the side member on opposite sides of the roof ridge at each end of the roof skid. On the lateral lower ladder it is preferred that there be a plurality of feet extending from the lower ladder to rest on the roof surface and support the lower ladder essentially parallel to the roof. The carriage to support a scaffold at selected positions on the lower ladder includes frames slidably fixed to the lower ladder sides, a floor on which a board may rest hingably attached at one edge to the frame, sidewalls depending downwardly from the floor in surface abutment with walls extending vertically and upwardly from each frame and a plurality of holes in each wall capable of alignment with insertion of a pin to fix the floor at a chosen angle to adjust to the pitch of the roof and allow the floor to be level.

A preferred embodiment of the invention is a roof skid suitable for placement on the ridge of a roof of a structure, including a frame that includes side rails along the length of the skid, that length to be laid in the same direction as the ridge of the roof. A structure is provided between the side rails to provide transverse support to hold the rails in a parallel relationship, preferably a plurality of cross members attached at each end to the side rails to hold them in a secure position. A floor covering the frame is provided, preferably extending between the side rails and attached to the cross members. A ridge support device is provided extending the length of the skid allowing the frame to rest on the ridge of the roof and in addition on sufficient surface area on both sides of the roof to support the roof skid. A frame edge support device is provided including at least four side support devices at each corner of the frame, with each including a roof support member hingably attached to the frame near the ridge support, that being near the center of the frame, and extending toward the roof surface. A lower foot support member is hingably attached to the free end of the roof support member and is intended to lay flat on the roof surface. A vertical support member is hingably attached to the frame near the side rail and is preferably of adjustable length. An interlocking device is provided to attach and interlock the free end of the vertical support member to the foot support member at selected points along the foot support member in a generally vertical direction.

Continuing with the preferred embodiments, it is preferred that the roof skid be provided with a rod along the outside of the side rail of the frame capable of supporting a substantial weight. A pivot angle ladder is attached to swing from the side rod and depend from it toward the roof surface. A lateral lower ladder system is rigidly attached to the free end of the pivot angle ladder at a chosen angle to extend parallel to the roof line. A plurality of feet devices are attached to the lower ladder to rest on the roof surface and support the lower ladder in an essentially parallel relationship to the roof. At least one carriage support is connected to each ladder system, fixed to the lower ladder to slide along the length at a selected position. Each carriage support includes a floor which is hingably attached at one edge to the frame attached to the lower ladder. Side walls depend downwardly from the floor in surface abutment with walls extending upwardly from the frame. A plurality of holes along the outside edge of each wall capable of alignment allows a pin device to be inserted through a pair of holes to fix the floor at the chosen angle.

An embodiment of the invention is roof skid 12 illustrated in FIG. 1, constructed essentially entirely of aluminum, except where noted, and is designed to fit over and be supported over the ridge of a roof. Skid 12 is symmetrical along the ridge center line so for simplicity only one side is described. The opposite side is identical. Side member rails 14 and 16 are held together with one inch diameter hollow tubes 18, crimped at ends 20 over outside surface 22 of rails 14 and 16. Tubes 18 are expanded against the inside surface of side rails 14 and 16 to secure the rails and tubes in position as a frame. The construction to this point is not unlike that of a simple ladder except that the tube placement is above the horizontal center line of the side rails. Floor 26 rests directly on tubes 18 in between rails 14 and 16. Floor 26 is constructed of corrugated aluminum sheet, fixed by pop rivets 30 in valleys 28 to tubes 18. Along the outside surface 22 of side rails 14 and 16 are attached steel hanger pipes 32, held at intervals by round clamps 34, bolted to box supports 36 which are in turn welded to surface 22. Hanger pipes 32 are provided on side rails 14 and 16 of roof skid 12 in the manner illustrated for attachment of ladders, carriages and the like to be described later. A ridge support structure includes inverted V-shaped ridge support channel 38 which approximates the shape of the ridge of standard roofs and is slightly more acute that the steepest roof structures. Channel 38 extends the length of skid 12. Rubber sheet 40 is adhesively attached to the contact under surface of ridge channel 38, to reduce damage of the roof and to provide a further distribution of the load. The cross-section of trapezoidal extrusion 42, as further illustrated in FIG. 3, has upper side about two and one-quarter inches long where it is attached to tubes 18. The angled side which is connected to ridge support 38 is about one and three-quarters inch in length, with the balance of the two sides about one and one-half inches long. Extrusion support 42 extends the length of roof skid 12 and is securely attached to ridge channel 38 by pop rivets and to the bottom edges of the end tubes 18 by metal screws or welding. In the partial cross-section of FIG. 3, interconnection between tubes 18 and side rail 14 with crimp and expansion 21 is illustrated. Floor 26 is attached with pop rivets 30 to tubes 18. Trapezoidal extrusion support member 42 is attached through screws 43 intermittently spaced directly into tubes 18. At appropriate points, holes 47 are provided in support 42 to allow reaching the screws. Angle ridge support 38 may be attached through pop rivets through the angled side of support 42 as illustrated or by other attachment means. Mating surfaces may all be welded together to form an integral unit. At each end and on both sides of skid 12 welded hinges 44 are connected on one side to the underside of extrusion 42 and on the other side of the hinge to the foot support system including roof support member 46. Member 46 at the lower end is connected through hinge 48 to foot plate 50 which rests on the roof and is padded with rubber sheet on the underside. The upper end of vertical support member 52 is hingably connected to either rail 14 or 16, as illustrated in expanded partial cutaway view of FIG. 3, and the lower end is connected to one of the chosen channels 54 of foot plate 50.

Figure 3:
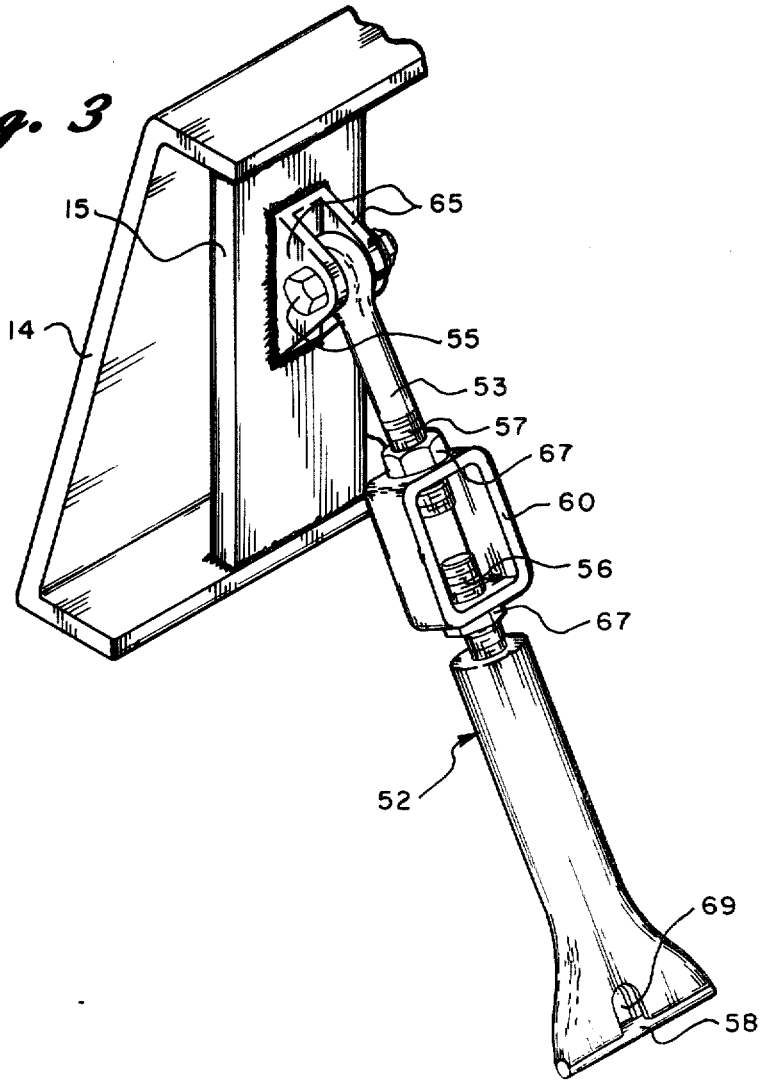
FIG. 3 is a partial close-up perspective view of the attachment of the vertical support in the roof skid of FIG. 1.
Figure 4:
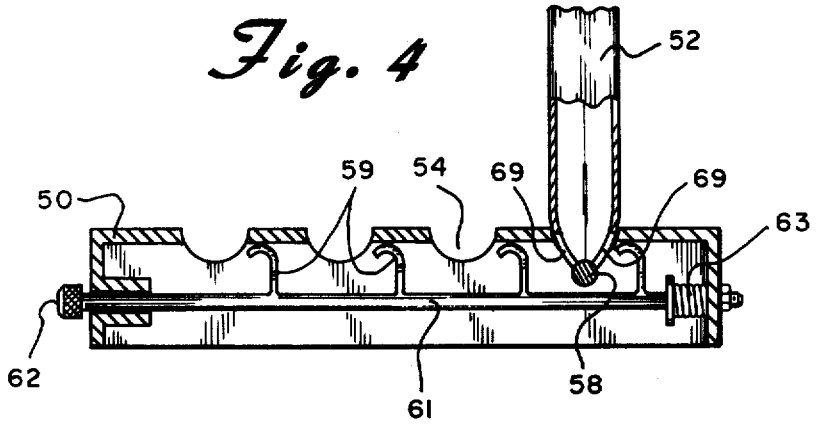
FIG. 4 is a cross-sectional view taken along lines 5—5 of FIG. 1, illustrating the interlocking mechanism for the foot of the vertical support.

As illustrated in FIG. 3, upper portion arm 53 of support 52 is hingably connected to the inside strut 15 welded to the inside of "V" shaped side rails 14 and 16 through horizontal bolt/nut combinations 55 locked between vertical members 65 spacably set apart a suitable distance to allow the upper portion of arm 53 of vertical support 52 to connect between and rotate in a vertical direction to allow proper positioning of vertical support 52. Threaded ends 57 on arm 53 and 56 on the lower section of vertical support 52 are connected by turn buckle 60, which allows adjustment of the length of support 52. The lower end of vertical support 52 is locked into foot plate 50 by internal mechanisms operated by release 62. As further illustrated in the cross-sectional view of FIG. 4, the lower end of vertical support 52 is equipped with horizontal rod 58, which is at the terminal end of support 52 and below a half circular cut-out aperture 69 over rod 58. When catch latch 62 is released, rod member 61 on which upright hooks 59 are attached is forced outwardly by spring 63 to engage and lock rod 58 of vertical support 52 in position.

Figure 5:
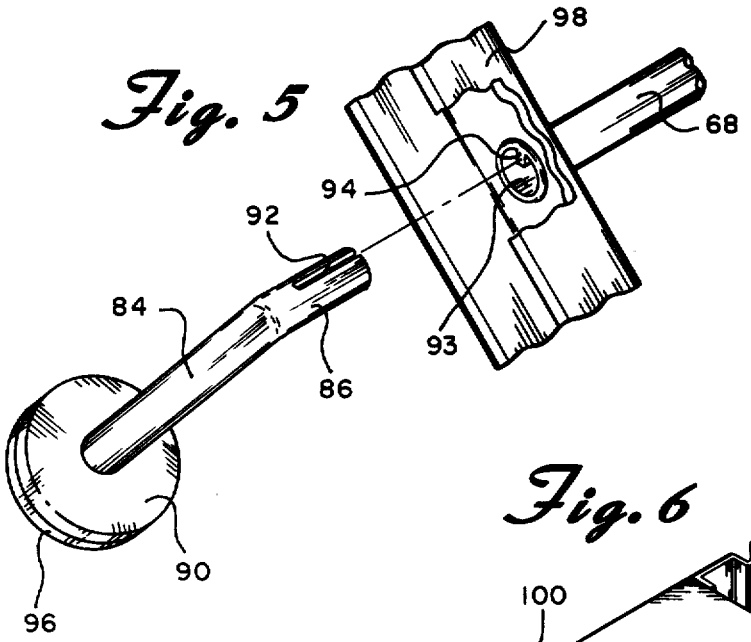
FIG. 5 is an expanded, partially cut away view of a foot and attachment to the lower ladder pictured in FIG. 1.

Hanging from support pipes 32 of skid 12 may be a variety of ladders and carriage devices including the one pictured in FIG. 1. While one ladder roof jack is pictured, it is common to provide one for each side on which scaffold planks rest. Vertical section ladder 64 is equipped with circular ring hangers 66, welded to connectors 68 which fit inside "V" shaped channels 70 of ladder 64 and are connected through lock bolts 72 at the upper end of ladder 64. The diameter of ring hangers 66 are such that pipe 32 fits through and allows rotational movement. The lower ends of ladder 64 are connected through threaded turn pin 74, tightening circular connectors 75 and 76, which have mating interlocking, saw-tooth surfaces to hold the connectors at any chosen vertical angle to each other and connect with lateral ladder 78. The threaded turn pin 74 inserts through an unthreaded hole in circular interlock plate 75 and into a threaded hole in circular interlock plate 76. The opposing surfaces of circular interlock plates 75 and 76 are equipped with radial, saw-toothed interlocking surfaces such that the angle of interlock may be varied. Interlock plates 75 and 76 are each respectively connected to interconnecting extensions 77 which fit into the channel of ladder side 70, to be held in position by stove bolts 79. Lateral ladder section 78 is designed to follow the slope of the roof, resting on L-shaped legs 84, wherein upper horizontal member 86 extends into any chosen inside hole of aluminum tube rungs 88 as more clearly shown in FIG. 5. The lower end of leg 84 is welded to circular foot plate 90 to which rubber disc 96 is adhesively attached to distribute the force on the roof surface. In FIG. 5 a closeup of a support leg 84 shows with a partial cutaway of "V" shaped channel 98, shows the interfitting of upper member 86 with key-way 92 into hole 93 interlocking onto key 94.

Figure 6:
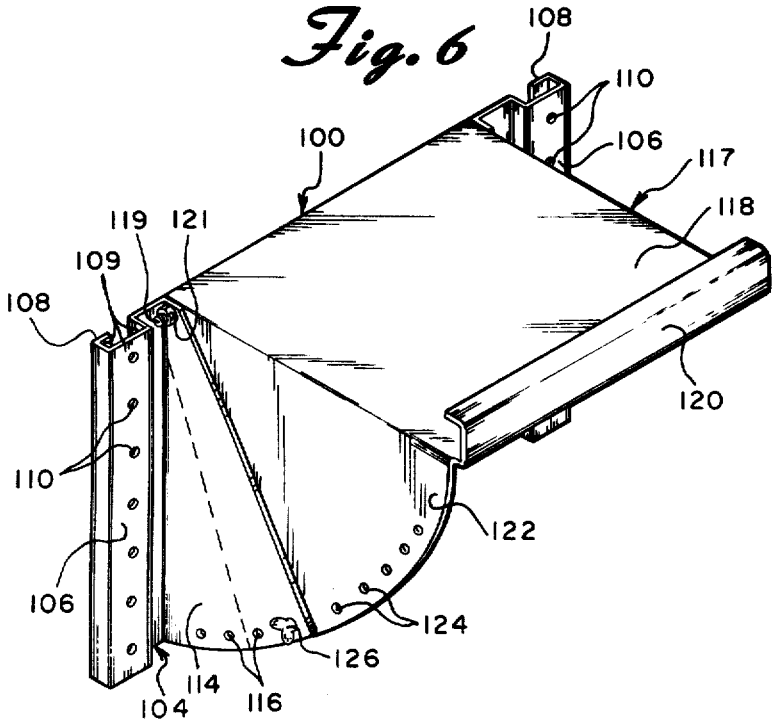
FIG. 6 is an expanded view of the carriage structure attached to the lower ladder in FIG. 1.

Carriage 100 on lateral ladder is more fully illustrated in FIG. 6. Carriage 100 is attached to lateral ladder 78 through holes 102 at essentially any level along ladder channel sides 98. Attachment member 104 is constructed of a continuous sheet of aluminum formed on one side to cover the top face of channel 98, with face plate 106 extending around the edge and under the edge with extension flange 108 to interlock onto the side of channel 98. A series of holes 110 extend the length of member 106 in a vertical direction for interconnection with holes 102 at the chosen height through thumb screw bolts and nuts through adjacent holes. A Teflon surface is fixed to the inside surface 109 of plate 106 and interlocking edge 108 as the surface rides up and down on the surface of ladder channel 98. The sheet of support 104 extends away from the plane of the ladder as vertical support plate 114 with its lower edge rounded to form a partial radial angle in the vertical direction. Along the lower edge of plate 114 are a number of regularly spaced holes 116, to interconnect with the carriage table. The carriage table 117 includes a horizontal table 118 equipped with an upwardly turned edge guard 120. Table member 118 pivots on rod 119 to the required angle to provide a horizontal surface. Bolts 121 hold rod 119 in position after it passes through holes of plate 114 and 122 on both sides of table 118. A piano type of hinge mechanism may be utilized in place of the rod 119 mechanism. From each side edge of table 118 continuations of the metal sheet form depending vertical support plates 122 which also provide a portion of a radial pie shaped angle, and are curved at their outer lower edge and extend to overlap with vertical support pie shaped plate 114. Together plates 122 and 114 preferably cover at least a 90° angle of the pie shape. Holes 124 in plate 122 align with holes 116 such that two mated holes may be chosen for interlocking thumb bolt and nut combination 126 for interlocking plates 122 and 114, thus fixing table 118 in a horizontal position regardless of the pitch of the roof. The roof jack 64 and 78 combination system may be duplicated on both sides of roof skid 12, and in fact there may be more than one on each side of a single roof skid. Ladder jacks will generally be balanced on each side of the roof skid so that both sides of the roof can be worked on at one time. For many jobs, two roof skids will be used each with ladder jacks depending from each side. With this configuration scaffolding planks on both sides will allow both sides of a ridged sloped roof to be covered at the same time. The top surface of the roof skids provide storage of the covering material, such as shingle bundles. Using two roof skids 12 it is possible to put sufficient shingle bundles to do half the job on the floors 26. It is not necessary to take the skid down in order to complete the entire job on both sides of the roof. The construction of the ladder jacks allows a lever to be placed under the ladder to lift lateral ladder 78 off the roof even while standing on it to allow removal of leg 84 from one position and move it to another position along the lateral ladder 78. In this way, the roof directly under lateral ladder 78 may be covered. The length of upper ladder 64 and in particular lateral ladder 78 may vary a good deal and may extend many feet along the surface of the roof. With this device it is also easy to attach a third hanging ladder from the lower end of lateral ladder 78. This hanging ladder may hang over the edge of the roof and allow the lowest portion of the roof to be easily covered. With the ladder jacks of the present invention the length of the boards may be increased substantially. In fact, aluminum extrusions may be used to extend the distance between the ladder jacks many additional feet. For ease of attachment, it is preferred that there be a number of clamps 66 located at various positions along pipe 32. In that way, the ladder jack may be attached and disattached at any position along the length of roof skid 12 and on either side of the ridge of the roof.

While I have described my invention in connection with specific embodiments, it is to be clearly understood that this description is made only by way of example and not of limitation to the scope of my invention as set forth in the following claims.

I claim:

1. A roof skid suitable for placement on the ridge of a sloped roof of a structure, comprising:

(a) a frame comprising side members along the length of the skid with the length to be laid along the same direction of the ridge of a roof, (b) a frame support means providing support for the frame to rest on the ridge of the roof and on both sides of the roof to support the roof skid, (c) at least one hanging support means attached on a side member to support hanging weight, (d) at least one pivot angle ladder attached to swing on the hanging support means and depending from the side member toward the roof surface, (e) a lateral lower ladder rigidly attached, adjustable to a chosen angle to the lower end of the pivot angle ladder, and (f) at least two feet means extending from the lower ladder to rest on the roof surface and support the lower ladder essentially parallel to the sloped roof surface.

2. The roof skid of claim 1 wherein the frame comprises a structure means extending the width of the skid between the side members providing transverse support to hold the rails in parallel relationship, and a floor covering the frame.

3. The roof skid of claim 2 wherein the structure means comprises a plurality of cross members, extending the width of the skid, structurally attached at the ends to the side members.

4. The roof skid of claim 2 wherein the floor is attached to the structure means between the side members.

5. The roof skid of claim 1 wherein the frame support means comprises a ridge support means extending the length of the skid allowing the frame to rest on the ridge of the roof and on sufficient surface area on both sides of the roof to support the rook skid.

6. The roof skid of claim 5 wherein the ridge support means comprises a "V" shaped beam conforming generally to the shape of the ridge of the roof, wherein the angle of the "V" shape is slightly less than that of the roof.

7. The roof skid of claim 6 wherein the angle beam support is covered with a resilient padding.

8. The roof skid of claim 5 wherein a trapezoidal shaped extrusion beam is structurally attached along the length of the ridge support means and the frame.

9. The roof skid of claim 1 wherein the frame support comprises at least four side support means at each corner of the frame, each comprising (1) a roof support member hingably attached to the frame near the ridge support and extending toward the roof surface, (2) a lower angled foot support member hingably attached to the free end of the roof support member, (3) a vertical support member hingably attached to the frame near the side member, and (4) an interlocking means to attach and interlock the free end of the vertical support member to the foot support member at selected points along the length of the foot support member, in a vertical direction, along the slope of the roof.

10. The roof skid of claim 9 wherein the foot support member has a plurality of generally horizontal transverse grooves, spaceably placed along the upper surface of the foot support.

11. The roof skid of claim 10 wherein the interlocking means comprises an opening on the free end of the roof support member, which fits in the grooves of the foot support member and an interlocking device means to hook the opening to hold the free end in the groove in an interlocking relationship.

12. The roof skid of claim 1 wherein the hanging support means comprises a horizontal rod attached along the outside of the side member of the frame.

13. The roof skid of claim 1 wherein there are two hanging support means each attached on the side member on opposite sides of the roof peak.

14. The roof skid of claim 13 wherein there are two pivot angle ladder and lateral lower ladder combinations, one each hanging from a hanging support means.

15. The roof skid of claim 1 wherein there are a plurality of feet means extending from the lower ladder to rest on the roof surface and support the lower ladder essentially parallel to the roof.

16. The roof skid of claim 1 wherein a carriage to support a scaffold at a selected position on the lower ladder comprises (a) frames slidably affixed to the lower ladder sides,
(b) a floor, on which a board may rest, hingably attached at one edge to the frames,
(c) side walls depending downwardly from the floor in surface abutment with
(d) walls extending from each frame, and
(e) a plurality of holes in each wall capable of alignment with insertion of a pin means to fix the floor at a chosen angle to adjust to the pitch of the roof and allow the floor to be level.

17. A roof skid suitable for placement on the ridge of a roof of a structure, comprising:

(a) a frame comprising side rails along the length of the skid with the length to be laid in the same direction as the ridge of a roof,
(b) a structure means extending the width of the skid between the side rails and providing transverse support to hold the rails in parallel relationship,
(c) a floor covering the frame,
(d) a ridge support means extending the length of the skid allowing the frame to rest on the ridge of the roof and on sufficient surface area on both sides of the roof to support the roof skid, and
(e) a frame support comprising at least four side support means at each corner of the frame, comprising
  (1) a roof support member hingeably attached to the frame near the ridge support and extending toward the roof surface,
  (2) a lower angled foot support member hingeably attached to the free end of the roof support member,
  (3) a vertical support member hingeably attached to the frame near the side rail, and
  (4) an interlocking means to attach and interlock the free end of the vertical support member to the foot support member at selected points along the length of the foot support member, in a vertical direction, along the slope of the roof.

18. The roof skid of claim 17 wherein the structure means comprises a plurality of cross members, extending the width of the skid, constructurally attached at the ends to the side rails.

19. The roof skid of claim 17 wherein the floor is attached to the structure means between the side rails.

20. The roof skid of claim 17 wherein the ridge support means comprises an angled piece conforming generally to the shape of the ridge of the roof, wherein the angle of the shape is slightly less than that of the roof.

21. The roof skid of claim 20 wherein the angle support is covered with a resilient padding.

22. The roof skid of claim 17 wherein a trapezoidal shaped extrusion is structurally attached to the ridge support means and to the frame.

23. The roof skid of claim 17 wherein the foot support member comprises a series of transverse grooves generally horizontal, spaceably placed along the upper surface of the foot support.

24. The roof skid of claim 17 wherein the interlocking means comprises an opening on the free end of the roof support member, which fits in the grooves of the foot support member and an interlocking device means to hook the opening and holding it in the groove in an interlocking relationship.

25. The roof skid of claim 17 wherein a horizontal side rod means is attached along the outside of the side rail of the frame, capable of supporting weight from the bar, a pivot angle ladder means attached to swing on the side rod means and depending from the side rail toward the roof surface,
a lateral lower ladder means rigidly attached at a chosen angle to the lower end of the pivot angle ladder means, capable of extending parallel to the roof surface in a vertical direction,
a plurality of feet means extending from the lower ladder means to rest on the roof surface and support the lower ladder essentially parallel to the roof.

26. The roof skid of claim 17 wherein a carriage to support a scaffold at a selected position on the lower ladder comprises (a) frames slidably affixed to the lower ladder sides,
(b) a floor on which material and/or a board may rest, hingably attached at one edge to the frames,
(c) side walls depending downwardly from the floor in surface abutment with
(d) walls extending from each frame attached to the ladder, and
(e) a plurality of holes in each wall capable of alignment with insertion of a pin means to fix the floor at a chosen angle to adjust to the pitch of the roof and allow the floor to be level.

* * * * *